US008753148B2

(12) United States Patent
Wozniak

(10) Patent No.: US 8,753,148 B2
(45) Date of Patent: Jun. 17, 2014

(54) ELECTRICAL CONNECTOR HAVING A SHIELD PLATE WITH CONTACT ENDS WITH NECK PORTIONS

(75) Inventor: Brian Wozniak, Hudson, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/301,462

(22) Filed: Nov. 21, 2011

(65) Prior Publication Data

US 2013/0130550 A1 May 23, 2013

(51) Int. Cl.
*H01R 13/648* (2006.01)

(52) U.S. Cl.
USPC ..... 439/607.05

(58) Field of Classification Search
USPC ..... 439/607.23, 607.05, 608
See application file for complete search history.

(56) References Cited

U.S. PATENT DOCUMENTS

| | | | | |
|---|---|---|---|---|
| 6,409,543 | B1 | 6/2002 | Astbury, Jr. et al. | |
| 6,872,085 | B1 | 3/2005 | Cohen et al. | |
| 7,508,681 | B2 * | 3/2009 | Payne et al. | 361/792 |
| 7,780,474 | B2 * | 8/2010 | Ito | 439/607.05 |
| 7,811,128 | B2 * | 10/2010 | Pan | 439/607.05 |

* cited by examiner

*Primary Examiner* — Chandrika Prasad
(74) *Attorney, Agent, or Firm* — Blank Rome LLP

(57) ABSTRACT

This invention relates generally to an electrical connector assembly for interconnecting printed circuit boards. More specifically, this invention relates to a high speed, high density electrical connector and connector assembly having wafers with an improved pin conductor. The connector contains a shield plate having at least one contact end that is bent in a direction perpendicular to the plane of the shield plate.

24 Claims, 6 Drawing Sheets

ELECTRICAL CONNECTOR HAVING A SHIELD PLATE WITH CONTACT ENDS WITH NECK PORTIONS

FIELD OF THE INVENTION

This invention relates generally to an electrical connector assembly for interconnecting printed circuit boards. More specifically, this invention relates to a high speed, high density electrical connector and connector assembly having wafers with an improved pin conductor.

BACKGROUND OF THE INVENTION

Electrical connectors are used in many electronic systems. It is generally easier and more cost effective to manufacture a system on several printed circuit boards ("PCBs") which are then connected to one another by electrical connectors. A traditional arrangement for connecting several PCBs is to have one PCB serve as a backplane. Other PCBs, which are called daughter boards or daughter cards, are then connected through the backplane by electrical connectors.

Electrical connectors can be designed for single-ended signals, as well as for differential signals. A single-ended signal is carried on a single signal conducting path, with the voltage relative to a common ground reference set of conductors being the signal. For this reason, single-ended signal paths are very sensitive to noise present on the common reference conductors. It has thus been recognized that this presents a significant limitation on single-ended signal use for systems with growing numbers of higher frequency signal paths.

Differential signals are signals represented by a pair of conducting paths, called a "differential pair." The voltage difference between the conductive paths represents the signal. In general, the two conducing paths of a differential pair are arranged to run near each other. If any other source of electrical noise is electromagnetically coupled to the differential pair, the effect on each conducting path of the pair should be similar. Because the signal on the differential pair is treated as the difference between the voltages on the two conducting paths, a common noise voltage that is coupled to both conducting paths in the differential pair does not affect the signal. This renders a differential pair less sensitive to cross-talk noise, as compared with a single-ended signal path. One example of a differential pair electrical connector is the GBX™ connector manufactured and sold by the assignee of the present application.

While presently available differential pair electrical connector designs provide generally satisfactory performance, the inventors of the present invention have noted that current high density connectors contain very small pins that are weak and sometime break when inserted into vias on the circuit board. This problem is especially apparent on the pins, particularly the press-fit tails, on the shield plate.

Therefore, there remains a need for a high speed, high density electrical connector and connector assembly design that provides stronger pins on the shield plate of the connector.

SUMMARY OF THE INVENTION

The present invention relates an electrical connector including a plurality of wafers, with each wafer having an insulative housing, a plurality of signal conductors and a shield plate. A portion of the shield plate is exposed so that a conductive member can electrically connect the shield plates of the wafers at the exposed portion of the shield plate. The exposed portion preferably contains press-fit contact tails aligned in a row. At least one of the contact tails is bent in a direction substantially perpendicular to the plane of the shield plate.

BRIEF DESCRIPTION OF THE DRAWINGS

The foregoing features of this invention, as well as the invention itself, may be more fully understood from the following description of the drawings in which.

DETAILED DESCRIPTION OF THE PREFERRED EMBODIMENT

Figure 1:
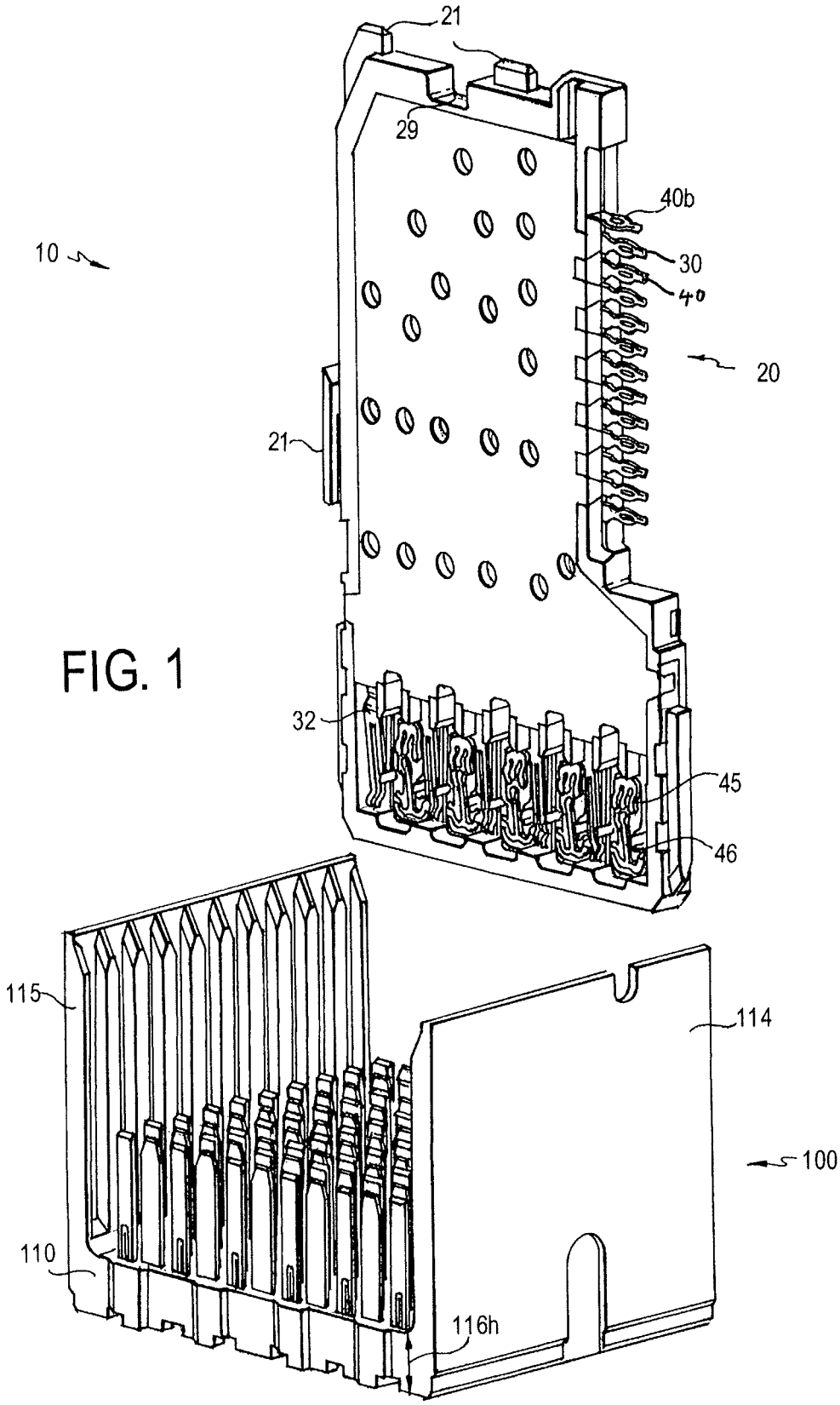
FIG. 1 is a perspective view of an embodiment of the electrical connector assembly of the present invention showing one of the wafers of a first electrical connector about to mate with a second electrical connector.

Referring to FIG. 1, there is shown an electrical connector assembly in accordance with an embodiment of the present invention. The electrical connector assembly 10 includes a first electrical connector mateable to a second electrical connector 100. The first electrical connector includes a plurality of wafers 20, only one of which is shown in FIG. 1, with the plurality of wafers 20 preferably held together by a stiffener, such as that disclosed in U.S. Pat. No. 6,872,085, which is incorporated herein by reference. If needed each of the wafers 20 can be provided with an attachment feature 21 for engaging the stiffener. For exemplary purposes only, the first electrical connector has ten wafers 20, with each wafer 20 having six single-ended signal conductors 24 and a corresponding shield plate 26 (see FIG. 2). However, as will be apparent a person skilled in the art, the number of wafers, the number of signal conductors and the number of shield plates may vary as desired.

Figure 2:
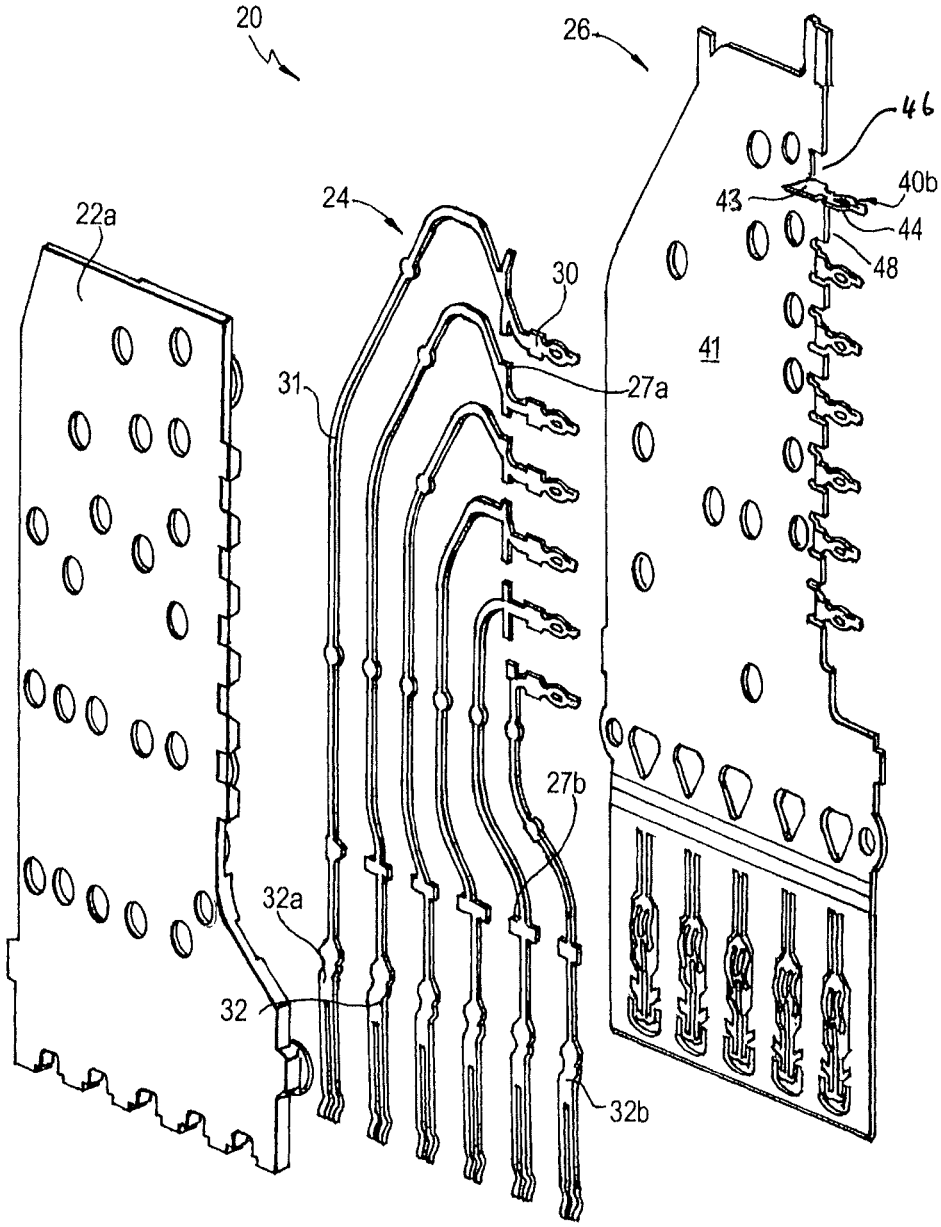
FIG. 2 is an exploded view of the wafer of the electrical connector utilizing single ended signals.

FIG. 2 is an exploded view of the wafer 20 which includes an insulative housing 22, formed around the signal conductors 24 and the shield plate 26, usually by a molding process. The signal conductors 24 are preferably disposed in the housing 22 over the shield plate 26. The signal conductors 24, for example, may be pressed into channels provided in the second housing portion 22*b*. The first housing 22 is then preferably molded over the assembly to form the wafer 20. The wafer assembly is more fully described in U.S. Pat. No. 6,409,543, which is incorporated herein by reference.

Each signal conductor 24 has a first contact end 30 connectable to a printed circuit board (not shown), a second contact end 32 connectable to the second electrical connector 100, and an intermediate portion 31 therebetween. Each shield plate 26 has a first contact end 40 connectable to the printed circuit board, a second contact end 42 connectable to the second electrical connector 100, and an intermediate plate portion 41 therebetween. The shield plate 26 is shown in greater detail in FIG. 3.

In an embodiment of the present invention, the first contact end 30 of the signal conductors 24 is preferably a press-fit contact tail; and the second contact end 32 of the signal conductors 24 is preferably a dual beam structure configured to mate to a corresponding mating structure of the second electrical connector 100. The first contact end 40 of the shield plate 26 also includes press-fit contact tails similar to the press-fit contact tails of the signal conductors 24. The second contact end 42 of the shield plate 26 includes opposing contacting members that are configured to provide a predetermined amount of flexibility when mating to a corresponding structure of the second electrical connector 100. While the drawings show contact tails adapted for press-fit, it should be apparent to one of ordinary skill in the art that the first contact end 30 of the signal conductors 24 and the first contact end 40 of the shield plate 26 may take any known form (e.g., pressure-mount contact tail, paste-in-hole solder attachment, contact pad adapted for soldering) for connecting to a printed circuit board.

Figure 4:
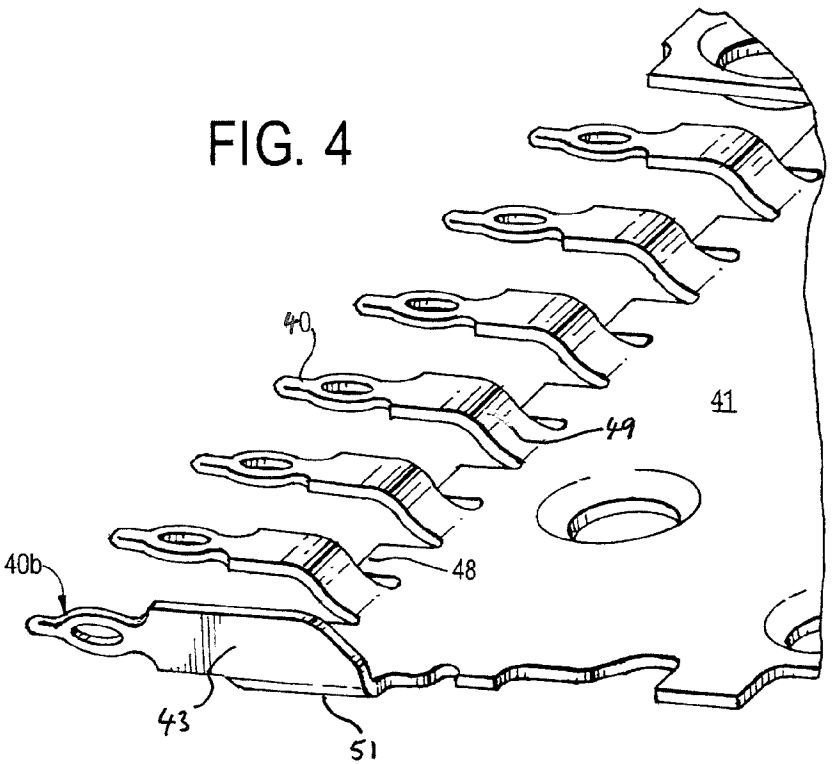
FIG. 4 is a perspective view of the first contact ends of the shield plate of the wafer of FIG. 2

Referring to FIG. 4, each of the first contact ends 40 of the shield plate 26 contains a neck portion 49 that brings the first contact end 40 out of the plane of the intermediate plate portion 41 and, when assembled in the wafer 20, toward a respective one of the signal conductors 24. The neck portion 49 aligns the first contact ends 40 of the shield plate 26 and the first contact ends 30 of the signal conductors 24 in a manner to achieve a desired electrical performance. In the non-limiting embodiment shown, the first contact ends 30 of the signal conductors 24 and the first contact ends 40 of the shield plate 26 are aligned in approximately a straight line when the wafer is assembled.

The neck portion 49 has a double bend so that the first contact end 40 extends outward from the intermediate plate portion 41, in a plane which is substantially parallel to the plane of the shield plate 26, as shown. The double bent neck portion 49, however, can operate as a spring when the first contact end 40 is inserted into the via of the PCB, where the insertion force pushes the first contact end 30 back against the double bend. The double bend neck portion 49 extends from the leading edge 48 of the intermediate plate portion 41 so that the connection between the neck portion 49 and the intermediate plate portion 41 is perpendicular to the direction of insertion. The bend is susceptible to being deformed and lose its spring force over time or if there is a slight misalignment during insertion of the first contact end 40 into the via. This can result in a weak first contact end 40 of the shield plate 26, and the possibility of breakage when inserted into the vias on the PCB. To relieve this weakness, a support member or rib can be positioned on the top or bottom surface of the neck portion 49.

At least one of the first contact ends 40 is formed by bending the contact end upward so that a body portion 43 is approximately perpendicular to the plane of the shield plate, and toward the signal conductors when assembled. FIG. 4 shows first contact end 40*b*, at one edge of the shield plate 26, being bent in this manner; however, other contact ends can also be bent in the same way. That first contact end 40*b* is bent upward toward the signal conductors 24 for the body portion 43 in a plane approximately perpendicular to the plane of the shield plate 26. The perpendicular contact end 40*b* can be formed by stamping a tab at the end of the shield plate, then folding the tab upward toward the signal conductors 24. The fold forms an elongated connection 51 between the first contact end 40*b* and a side edge of the intermediate plate portion 41 and is preferably substantially parallel to the central longitudinal axis of the first contact end 40*b* and perpendicular to the leading edge 48 of the shield plate 26. Due to the bend in the body portion 43 toward the signal conductors 24, the first contact end 40*b* is aligned with the first contact ends 30 of the signal conductors 24 and the other first contact ends 40 of the shield plate 26 to form a substantially linear line.

Figure 3:
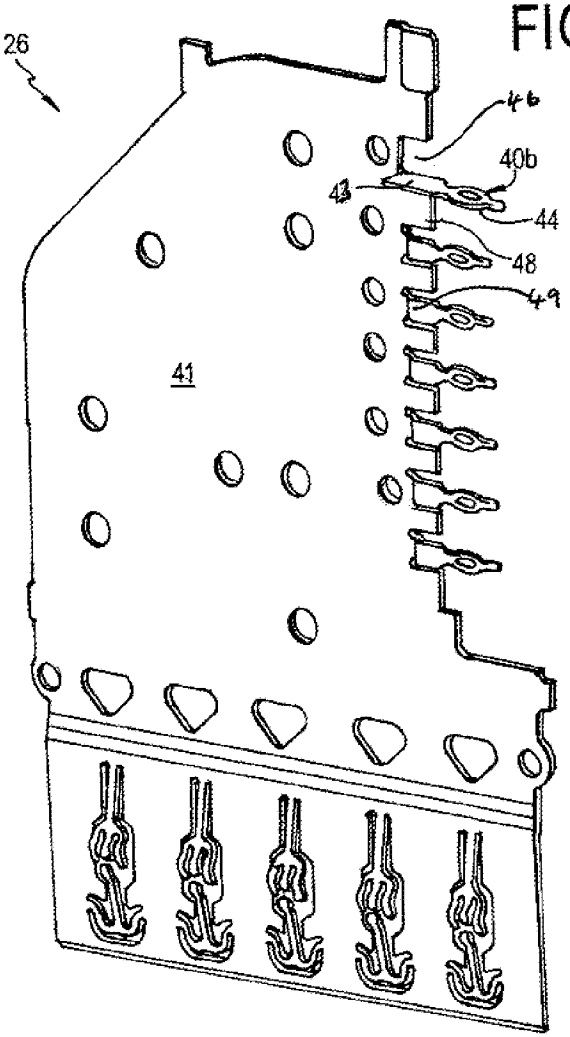
FIG. 3 is a perspective view of a shield plate of the wafer of FIG. 2.

The bent first contact end 40*b* need not be at an edge of the shield plate 26, as illustrated in FIG. 4. Rather, the bent contact end 40*b* can be positioned along the leading edge 48 of the shield plate 26, as shown in FIG. 3. Here, the body 43 of the contact 40*b* is punched out of the intermediate plate portion 41 along the leading edge 48, which forms an opening 46 in the intermediate plate portion 41. The bent contact end 40*b* has a body portion 43 that attaches to and is integral with the intermediate plate portion 41 along one side to form the connection 51, and has an opposing side and rear side that are unattached to and free from the intermediate plate portion 41. The bent contact end 40*b* is a single piece of material that contains a body portion 43 and a contact pin portion 44. The body portion 43 is integral with the shield plate 26 and shares an elongated side edge with the shield plate 26. The contact pin portion 44 projects forward from the body portion 43. In effect, the contact pin portion 44 is supported by the body portion 43 which, in turn, is supported by the shield plate 26. That results in a strong contact end 40*b*, which produces a more reliable, rigid connection with the PCB.

Both the leading edge contact 40*b* (FIG. 3) and the side edge contact 40*b* (FIG. 4) provide a strong contact 40*b*. Each of those has a connection 51 to the intermediate portion 41 that is parallel to the direction of the insertion force. That provides a strong and durable connection that is better able to oppose the insertion force. Although the body portion 43 is illustrated as supporting only one contact pin portion 44, more than one contact pin portion 44 can be provided on a single body portion 43.

Figure 5:
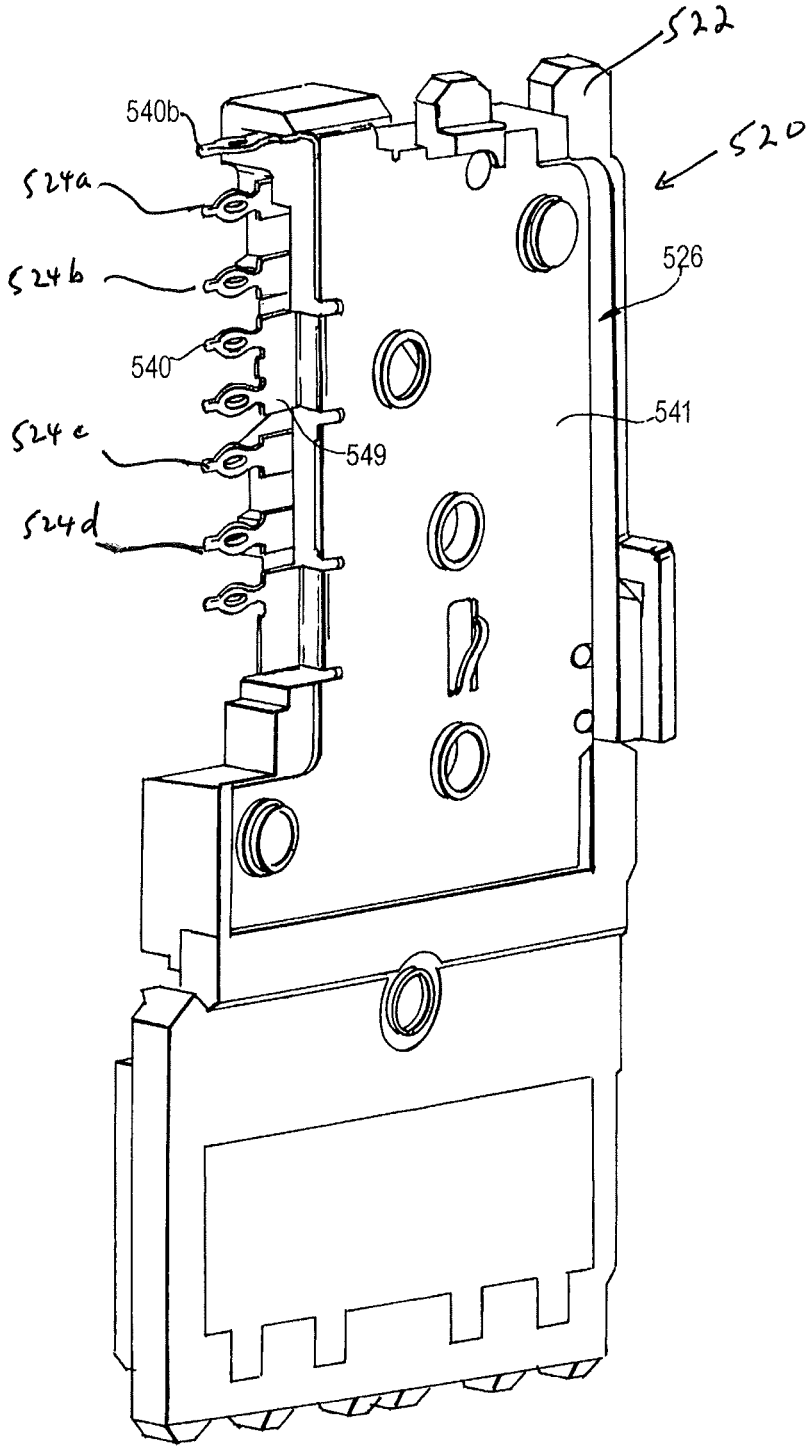
FIG. 5 is an exploded view of the wafer of the electrical connector utilizing differential pair signals.
Figure 6:
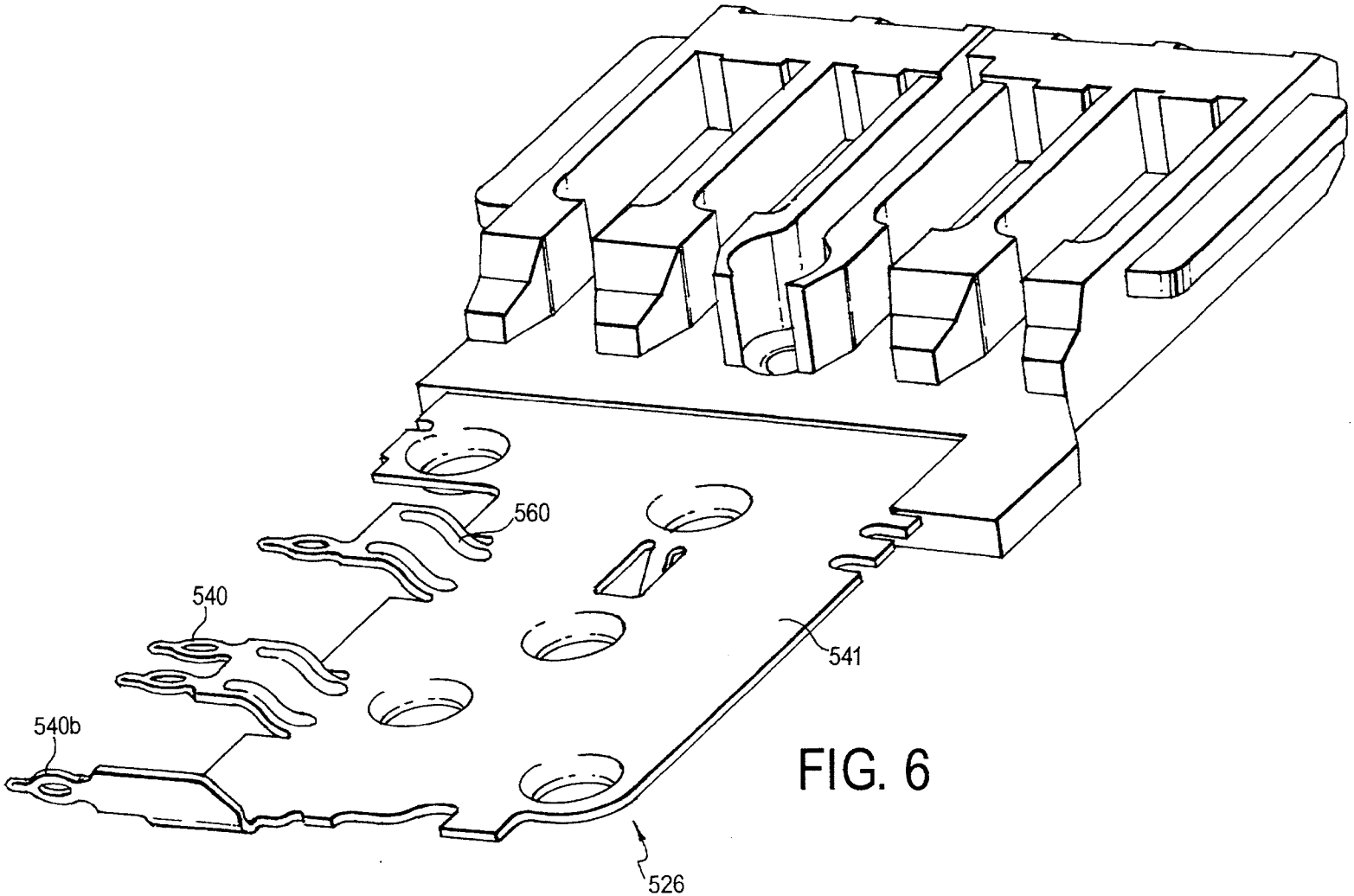
FIG. 6 is a perspective view of a shield plate of the wafer of FIG. 2.

FIGS. 1-4 show embodiments of the present invention as applied to a connector having single ended signals. The same concept, however, is also applicable to connectors having differential pairs, as shown in FIGS. 5-6. FIG. 5 shows an enlarged view of a wafer 520 for a connector utilizing differential pairs. This wafer is similar to the wafer 20 shown in FIG. 2, but with the signal conductors 524 being grouped in pairs 524*a* and 524*b*, 524*c* and 524*d*. The wafer 520 includes an insulative housing 522, formed around the signal conductors 524 and the shield plate 526, usually by a molding process. The wafer 520 is formed as previously noted for the wafer 20.

Each signal conductor 524 has a first contact end connectable to a printed circuit board (not shown), a second contact end connectable to the second electrical connector, and an intermediate portion therebetween. Each shield plate 526 has a first contact end 540 connectable to the printed circuit board, a second contact end 542 connectable to the second electrical connector, and an intermediate plate portion 541 therebetween. The shield plate 526 is shown in greater detail in FIG. 6. Overall, because the signal conductors 524 are grouped in pairs, the relative positioning of the first contact ends of the signal conductors 524 and the first contact ends 540 of the shield plate 526 are slightly different than the shield plate 26 of the wafer 20 (shown in FIGS. 1-4). For the single ended signal wafer 20, the first contact ends alternate between signal conductor and shield plate, while for the signal pair wafer 500, the first contact ends of each pair are separated by a first contact end of the shield plate. Thus, for the single ended signal wafer 20, the pattern of the first end is G-S-G-S-G-S-G, where G signifies a first contact end of the shield plate (a ground signal), and S signifies a first contact end of a signal conductor (a positive or negative signal); for the signal pair wafer 520, the pattern is G-S-S-G-S-S-G.

Referring to FIG. 6, each of the first contact ends 540 of the shield plate 526 contains a neck portion 549 that brings the first contact end 540 out of the plane of the shield plate 526 and, when assembled in the wafer 520, toward the signal conductor 24. As previously explained for the wafer 20, the neck portion 549 aligns the first contact ends 540 of the shield plate 526 and the first contact ends 530 of the signal conductors 524 in approximately a straight line when the wafer is assembled. Further, at least one of the first contact ends 540 is formed by bending the contact end so that it is approximately perpendicular to the plane of the shield plate, and toward the signal conductors when assembled. FIG. 6 shows first contact end 540*b*, at the edge of the shield plate 526, being bent in this manner. That first contact end 540*b* is bent toward the signal conductors 524 in a plane approximately perpendicular to the plane of the shield plate 526. Due to the bend toward the signal conductors 524, the first contact end 540*b* also aligns with the first contact ends 530 of the signal conductors and the other first contact ends 40*b* of the shield plate 26 to form a substantially linear line. In doing so, however, there is no bends in the neck portion of the first contact end 540*b*.

In certain embodiments the neck portion 49 or 549 can include a rib 660 to strengthen the neck portion 49 of 549. This rib 660 provides reinforcement in the neck portion 49 or 549 to provide strength. However, a rib is not needed in the bent first contact end 40*b* or 540*b* because it does not require the reinforcement.

Figure 7:
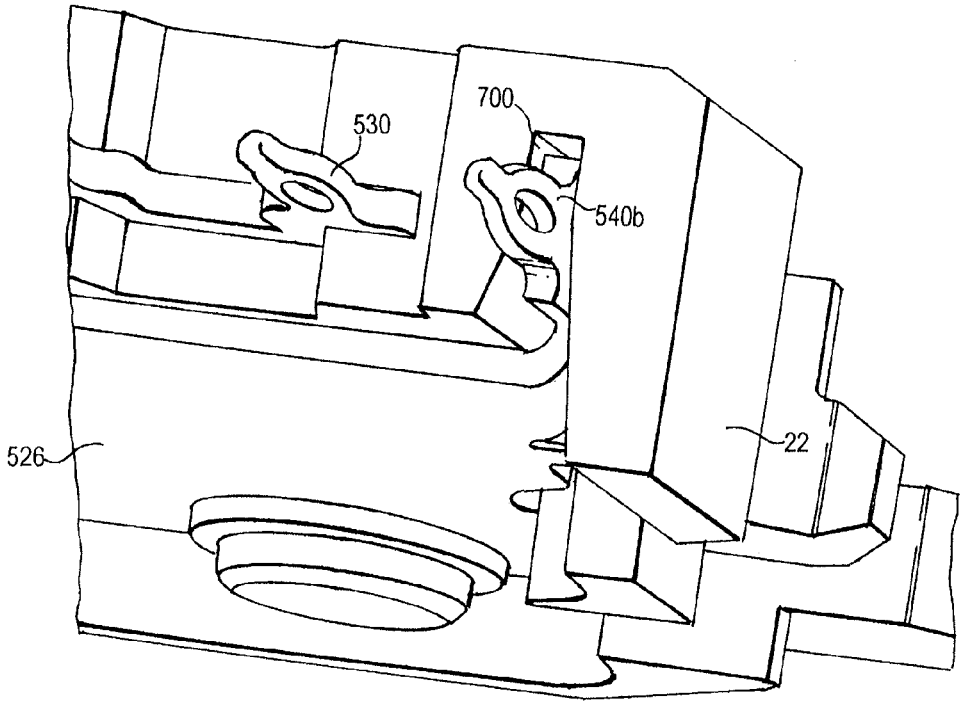
FIG. 7 is a perspective view of the wafer assembly at the first contact ends.

FIG. 7 shows the assembly of the bent first contact end 40*b* or 540*b* in the wafer 20 or 520. Essentially, the perpendicular first contact end 40*b* or 540*b* of the shield plate 26 or 526 fits in to a notch 700 in the in the insulated housing 22 or 522. While the remaining parts of the shield plate 26 or 526 lays flat on a surface of the insulated housing 22 or 522.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An electrical wafer comprising:

an insulative housing;

a plurality of signal conductors disposed in the insulative housing, each signal conductor having a first contact end extending in a first direction and connectable to a printed circuit board, a second contact end, and an intermediate portion extending therebetween; and a shield plate disposed in the insulative housing, the shield plate having a top surface and at least one side, a plurality of first contact ends having contact pin portions connectable to the printed circuit board and a plurality of second contact ends, wherein at least one of the plurality of first contact ends of the shield plate includes a body portion having a longitudinal edge, the longitudinal edge being integrally connected to the at least one side of the shield plate and the body portion extending perpendicularly outward from the top surface of the shield plate, wherein a portion of each of the plurality of first contact ends of the shield plate excluding the at least one first contact end includes a neck portion that bends at an angle other than 90 degrees to the first direction of the plurality of signal conductors and further bends in the first direction of the plurality of signal conductors.

2. The electrical wafer of claim 1, wherein the first contact ends of the plurality of signal conductors and the plurality of first contact ends of the shield plate are aligned in a substantially straight line.

3. The electrical wafer of claim 1, wherein the shield plate has two sides intersecting to form a corner, and the longitudinal edge of the body portion is integrally connected to one of the sides at a location that is closest to the corner.

4. The electrical wafer of claim 1, wherein each of the neck portions includes a rib.

5. The electrical wafer of claim 1, wherein the plurality of signal conductors include differential signal conductor pairs.

6. The electrical wafer of claim 1, wherein the first contact ends of the plurality of signal conductors and the plurality of first contact ends of the shield plate are pressed-fit contact tails.

7. The electrical wafer of claim 1, wherein the contact pin portion of the at least one first contact end of the shield plate extends in a direction parallel to an insertion direction of the electrical water into the printed circuit board.

8. An electrical connector comprising a plurality of electrical wafers, each electrical wafer including:

an insulative housing;

a plurality of signal conductors disposed in the insulative housing, each signal conductor having a first contact end extending in a first direction and connectable to a printed circuit board, a second contact end, and an intermediate portion extending therebetween; and a shield plate disposed in the insulative housing, the shield plate having a top surface and at least one side, a plurality of first contact ends having contact pin portions connectable to the printed circuit board and a plurality of second contact ends, wherein at least one of the plurality of first contact ends of the shield plate includes a body portion having a longitudinal edge, the longitudinal edge being integrally connected to the at least one side of the shield plate and the body portion extending perpendicularly outward from the top surface of the shield plate, wherein a portion of each of the plurality of first contact ends of the shield plate excluding the at least one first contact cud includes a neck portion that bends at an angle other than 90 degrees to the first direction of the plurality of signal conductors and further bends in the first direction of the plurality of signal conductors.

9. The electrical connector of claim 8, wherein the plurality of electrical wafers are aligned adjacent to each other.

10. The electrical connector of claim 8, wherein the first contact ends of the plurality of signal conductors and the plurality of first contact ends of the shield plate are aligned in a substantially straight line.

11. The electrical connector of claim 8, wherein the shield plate has two sides intersecting to form a corner, and the longitudinal edge of the body portion is integrally connected to one of the sides at a location that is closest to the corner.

12. The electrical connector of claim 8, wherein each of the neck portions includes a rib.

13. The electrical connector of claim 8, wherein the plurality of signal conductors include differential signal conductor pairs.

14. The electrical connector of claim 8, wherein the first contact ends of the plurality of signal conductors and the plurality of first contact ends of the shield plate are pressed-fit contact tails.

15. A method for making an electrical wafer comprising the steps of providing a plurality of signal conductors, each signal conductor having a first contact end extending in a first direction and connectable to a printed circuit board, a second contact end, and an intermediate portion extending therebetween;

providing a shield plate, the shield plate having a top surface and at least one side, a plurality of first contact ends having contact pin portions connectable to the printed circuit board and a plurality of second contact ends, wherein at least one of the plurality of first contact ends of the shield plate includes a body portion having a longitudinal edge, the longitudinal edge being integrally connected to the at least one side of the shield plate and the body portion extending perpendicularly outward from the top surface of the shield plate; and molding an insulative housing around the plurality of signal conductors and the shield plate, wherein a portion of each of the plurality of first contact ends of the shield plate excluding the at least one first contact end includes a neck portion that bends at an angle other than 90 degrees to the first direction of the plurality of signal conductors and further bends in the first direction of the plurality of signal conductors.

16. The method of claim 15, wherein the first contact ends of the plurality of signal conductors and the plurality of first contact ends of the shield plate are aligned in a substantially straight line.

17. The method of claim 15, wherein the shield plate has two sides intersecting to form a corner, and the longitudinal edge of the body portion is integrally connected to one of the sides at a location that is closest to the corner.

18. The method of claim 15, wherein each of the neck portions includes a rib.

19. A shield plate for use in an electrical wafer of an electrical connector, the shield plate comprising:

a plurality of first contact ends having contact pin portions extending in a first direction and connectable to a printed circuit board; and a plurality of second contact ends, wherein the shield plate has a top surface and at least one side, and at least one of the plurality of first contact ends of the shield plate includes a body portion having a longitudinal edge, the longitudinal edge being integrally connected to the at least one side of the shield plate and the body portion extending perpendicularly outward from the top surface of the shield plate, wherein a portion of each of the plurality of first contact ends of the shield plate excluding the at least one first contact end includes a neck portion that bends at an angle other than 90 degrees to the first direction of the plurality of signal conductors and further bends in the first direction of the plurality of signal conductors.

20. The shield plate of claim 19, wherein the shield plate has two sides intersecting to form a corner, and the longitudinal edge of the body portion is integrally connected to one of the sides at a location that is closest to the corner.

21. The shield plate of claim 19, wherein each of the neck portions includes a rib.

22. The shield plate of claim 19, wherein the first contact ends of the plurality of signal conductors and the plurality of first contact ends of the shield plate are pressed-fit contact tails.

23. The shield plate of claim 19, wherein the contact pin portion of the at least one first contact end of the shield plate extends in a direction parallel to an insertion direction of the electrical wafer into the printed circuit board.

24. An electrical connector comprising a plurality of electrical wafers, each electrical wafer including:

a shield plate having a top surface and at least one side, and a plurality of contact ends having contact pill portions extending in a first direction and connectable to an electrical connector, wherein at least one of the plurality of contact ends of the shield plate includes a body portion having a longitudinal edge, the longitudinal edge being integrally connected to the at least one side of the shield plate and the body portion extending perpendicularly outward from the top surface of the shield plate, wherein a portion of each of the plurality of contact ends of the shield plate excluding the at least one contact end include a neck portion that bends at an angle other than 90 degrees to the first direction of the plurality of signal conductors and further bends in the first direction of the plurality of signal conductors.

* * * * *